US005172924A

United States Patent [19]

Barci

[11] Patent Number: 5,172,924

[45] Date of Patent: Dec. 22, 1992

[54] HARD SHELL BOOT SNOWBOARD BINDINGS AND SYSTEM

[76] Inventor: Robert S. Barci, 36110 SE. 25th, Fall City, Wash. 98024

[21] Appl. No.: 676,935

[22] Filed: Mar. 27, 1991

[51] Int. Cl.[5] ..... A63C 9/00

[52] U.S. Cl. ..... 280/14.2; 280/607; 280/617; 280/633

[58] Field of Search ..... 280/14.2, 14.3, 87.021, 280/87.041, 87.042, 602, 607, 617, 618, 620, 633, 634, 636, 811; 441/70

[56] References Cited

U.S. PATENT DOCUMENTS

| | | | |
|---|---|---|---|
| 3,801,119 | 4/1974 | Andre | 280/620 X |
| 3,900,204 | 8/1975 | Weber | 280/14.2 |
| 4,008,908 | 2/1977 | Pierson | 280/636 |
| 4,147,377 | 4/1979 | Plenk | 280/607 X |
| 4,568,296 | 2/1986 | Newell | 280/636 X |
| 4,652,007 | 3/1987 | Dennis | 280/618 |
| 4,741,550 | 5/1988 | Dennis | 280/618 |
| 4,772,041 | 9/1988 | Klosterman | 280/633 X |
| 4,856,808 | 8/1989 | Longoni | 280/617 |
| 4,979,760 | 12/1990 | Derrah | 280/607 |
| 5,026,086 | 6/1991 | Guers et al. | 280/607 |
| 5,028,068 | 7/1991 | Donovan | 280/14.2 X |

FOREIGN PATENT DOCUMENTS

| | | | |
|---|---|---|---|
| 2723864 | 11/1978 | Fed. Rep. of Germany | 280/607 |
| 3702094 | 8/1988 | Fed. Rep. of Germany | 280/14.2 |
| 3811096 | 10/1989 | Fed. Rep. of Germany | 280/14.2 |
| 74548 | 1/1949 | Norway | 280/811 |
| 593031 | 11/1977 | Switzerland | 280/618 |

OTHER PUBLICATIONS

Product Catalog for Burton Snowboards, 1990, pp. 14–20.

*Primary Examiner*—Charles A. Marmor
*Assistant Examiner*—Brian L. Johnson
*Attorney, Agent, or Firm*—Dean A. Craine

[57] ABSTRACT

A binding adapted for use with hard shell boots which allows the rider or shredder to laterally move and axial rotate the boot when connected thereto. The binding is essentially stepin type binding comprising a flexible heel piece, a heel plate, and a semi-rigid toe piece. A strap structure is attached to the flexible heel piece which enables the shredder to adjust the tension thereof. The heel plate is mounted to the inside surface of the flexible heel piece and holds the rear portion of the boot downward in the binding. In addition, the heel plate allows the shredder to laterally move, and if pivotally mounted, allows axial rotation of the boot while connected to the binding. An optional base member may be interposed longitudinally between the semi-rigid toe piece and the flexible heel piece. Each base member embodiment disclosed herein has an upper boot support surface which supports the sole of the boot and either facilitates or limits lateral movement and axial rotation of the boot while connected to the binding. The binding system which allows the shredder to use one snowboard for various riding activities. The binding system comprises two bindings mounted in the front and rear binding locations on the snowboard, and a set of base members containing a plurality of pairs of base members with each pair of base members having an unique upper boot support surface manufactured thereon.

23 Claims, 8 Drawing Sheets

HARD SHELL BOOT SNOWBOARD BINDINGS AND SYSTEM

TECHNICAL FIELD

The present invention relates generally to binding devices used to secure a user's boot to a snow vehicle and, more particularly, to binding devices used to secure a hard shell boot to a snowboard.

BACKGROUND ART

Snowboard riders, called shredders, generally participate in two general riding activities—downhill and freestyle. For each riding activity, shredders must be able to control the snowboard and must be able to perform a myriad of maneuvers. Generally, the shredder controls the snowboard and performs the maneuvers by moving his weight and shifting various parts of his body. Because the shredder uses his feet to carry out these tasks, the boot and binding equipment that he uses is very important.

Today, there are two general types of boots and bindings used by shredders. The first type of boot is the hard shell boot, also called the either the standard ski boot or a ski-mountaineering boot or a variation thereof. The hard shell boot is a stiff boot made of leather with an outer hard plastic shell. It is designed to provide maximum ankle support and protection. With the hard shell boot, a compatible binding, called a rigid plate binding, is used to firmly attach the sole of the boot to the top surface of the snowboard. As its name suggests, the typical rigid plate binding consists of a rigid plate structure which uses cables or wires to securely connect the boot thereto. One unique feature about the connection between the hard shell boot and rigid plate binding is that it is relatively firm with little or no "play" allowed for the shredder to move the boot independently of the binding.

One result of the firm connection between the hard shell boot and the rigid plate binding is better performance. Because of the stiffness of the hard shell boot and the firm attachment between the hard shell boot and the rigid plate binding, the shredder is able to generate great leg power directly to the snowboard. This results in quicker, more efficient snowboard response. Also, the firm connection provides excellent edge feeling and control.

There are several drawbacks, however, with the hard shell boots and rigid plate bindings used today. First, because the hard shell boot is relatively stiff and firmly attached to the rigid plate binding, the shredder is unable to perform many of the maneuvers used in freestyle. Another drawback is that the hard shell boot and rigid plate binding can not be easily and conveniently connected and disconnected. Today, snowboarding and skiing operations are generally held at the same mountain site locations. At these locations, shredders and skiers must share the chair-lift and rope-tow equipment which were originally designed for skiers. In order for shredders to use this equipment, they must disconnect their rear boots from their bindings which allows them to ride "skate-board style" across the terrain and to the entrance ramps of the chair-lift or rope tow. While riding on the chair-lift or rope tow, the shredder must then quickly connect the rear boot to the rear binding before exiting and, of course, without falling and stopping. With hard shell boots and typical rigid plate bindings used today, quick and easy connection and disconnection of the rear boot and rear binding is not possible.

The second type of boot, called a freestyle or soft shell boot, is made of soft leather, plastic, and nylon. It is designed to be more flexible and more comfortable than the hard shell boot mentioned above. Like the hard shell boot, a soft shell boot must be used with a compatible binding, called a freestyle or high-back binding. Generally, high-back bindings consists of wrap structures and adjustable straps which act to hold the soft shell boot to the top surface of the snowboard. Due to the manner in which the boot is retained in the high back binding, the shredder is able to twist and turn his boot while connected thereto. This movement of the boot while connected to the binding, allows the shredder to perform the maneuvers used today in freestyle riding.

There are several drawbacks, however, with using soft shell boots and high-back bindings. First, because soft shell boots and high-back bindings provide less ankle support and protection, a greater number of injuries can occur to these areas while shredding. When shredding, variations in the terrain and texture of the hillside cause movement of the snowboard. This movement, together with the shredder's body movements when performing maneuvers, causes tremendous stress to the ankle and foot. Second, because the soft shell boots have greater flexibility and are not firmly attached to the high-back bindings, soft shell boots and high-back bindings do not provide good edge feeling and control that hard shell boots and rigid plate bindings provide. Third, like hard shell boots and rigid plate bindings, soft shell boots and high-back bindings can not be easily and conveniently connected while shredding at modern skiing operations.

Today, many professional and recreational shredders find it desirable to use binding equipment which will enable them to perform optimally in both downhill and freestyle activities. Also, many shredders find it desirable to use binding equipment which will provide the greatest amount of ankle and foot protection. Further, many shredders find it desirable to use binding equipment which can be easily and quickly connected and disconnected for shredding at modern skiing operations.

The present invention, described herein, provides a binding which is designed to satisfy these and other desires.

DISCLOSURE OF INVENTION

It is a general object of the present invention to provide a binding for snowboards.

It is an object of the present invention to provide such a binding which is adapted for use with a hard shell boot to provide maximum ankle and foot protection, great leg power, and good edge control and edge feeling while shredding.

It is another object of the present invention to provide such a binding which is has a step-in design to allow easy and convenient boot connection and disconnection.

It is another object of the present invention to provide such a binding which has great flexibility to allow the shredder to perform maneuvers used in freestyle riding activities.

It is a further object of the present invention to provide such a binding in which the flexibility of the binding can be selectively modified by the shredder for different riding activities or terrains.

It is a still further object of the present invention to provide a binding system which allows the shredder to adjust two bindings attached to the snowboard for different riding activities.

These and other objects of the invention are met by providing a binding for a snowboard described herein. The binding is designed to be a step-in type binding adapted for use with a hard shell boot. The binding is designed to be durable and strong under extreme temperature conditions and sufficiently flexibly to allow limited lateral movement and axial rotation of the boot when attached thereto. The amount of flexibility the binding may be selectively adjusted by the shredder so that a proper amount of lateral movement and axial rotation is allowed by the binding for a specific or a combination of riding activities.

The binding comprises a flexible heel piece and a semirigid toe piece. The flexible heel piece flexibly holds the rear portion of the boot in the binding when connected thereto. An adjustable securing means is attached to the flexible heel piece which allows the shredder to selectively adjust the tension of the flexible heel piece. By adjusting the tension of the flexible heel piece, the shredder is able to adjust the flexible of the flexible heel piece for different riding activities.

The flexible heel piece, which is rigidly attached to the top surface of the snowboard, comprises, in the preferred embodiment, a first and a second wrap member which together partially wrap around the rear portion of the boot when connected to the binding. During manufacture, the inherent flexibility of the flexible heel piece may be adjusted by manufacturing the first and second wrap members in various shapes and sizes.

The flexible heel piece also has a heel holding means mounted to the inside thereof which securely holds the rear portion of the boot in the binding when the boot is connected thereto. In one embodiment, the heel holding means is a heel plate pivotally mounted to the inside surface of the flexible heel piece. When the heel plate is pivotally mounted, the shredder can axially rotate the boot if a suitable base member is used with the binding. The heal holding means is mounted inside the flexible heel piece so that when the tension of the adjustable securing means is increased or decreased, the connection between the heel holding means and the rear portion of the boot is increased or decreased, respectively. By the shredder selectively increasing or decreasing the tension of the adjustable securing means, lateral movement and axial rotation of the boot in the binding may be adjusted.

The semi-rigid toe piece is attached to the front of the binding which is designed to allow the toe portion of the boot to slidingly engage therewith. The semi-rigid toe piece is also designed so that the shredder may laterally move and axial rotate the rear portion of the boot when desired.

The semi-rigid toe piece, flexible heel piece, the heel holding means, and adjustable securing means are also designed to provide a step-in type binding so that the shredder can quickly and easily connect and disconnect the boot from the binding.

An optional base member may be used in the binding to control lateral movement and axial rotation of the boot when connected to the binding. In the preferred embodiment, the base member is an elongated member rigidly attached and interposed longitudinally between the flexible heel piece and semi-rigid toe piece. The base member has an upper boot support surface upon which supports the sole of the boot when the boot is connected to the binding. Several embodiments of the base member are disclosed herein each having an unique upper boot support surface. By selecting and attaching a base member having a suitable upper boot support surface to the binding and by adjusting the tension of the flexible heel piece, the shredder is able to adjust the binding so that a desirable amount of lateral movement and axial rotation is provided. In this manner, a means is provide whereby the shredder is able to adjust the binding for a specific riding activity or a combination of riding activities.

An optional snow shield is disclosed herein which attaches to the front, outside surface of the semi-rigid toe piece when the binding is mounted in the front binding position. The snow shield is used to prevent snow build-up on the front surface of the semi-rigid toe piece and to prevent snow from entering semi-rigid toe piece. When shredding at fast speeds, the snow shield also acts to streamline the flow of snow and air over the binding to prevent yawing.

An optional snow deflector is also disclosed herein which attaches to the rear, outside surface of the flexible heel piece when the binding is mounted in the rear binding position on the snowboard. The snow deflector acts to prevent snow from inadvertently opening the adjustable securing means and thereby causing the flexible heel piece to loosen during use.

Also disclosed herein is a binding system comprising two of the bindings described above mounted in the front and rear binding positions of a snowboard. The binding system also includes a set of exchangeable base members capable of being attached to either binding. In the preferred embodiment, the set of base members comprises a plurality of base member pairs with each pair having a unique upper boot support surface formed thereon. When using the binding system, the shredder is able to attach and exchange the base members in each binding for a particular riding or combination of riding activities.

BEST MODE FOR CARRYING OUT THE INVENTION

Figure 1:
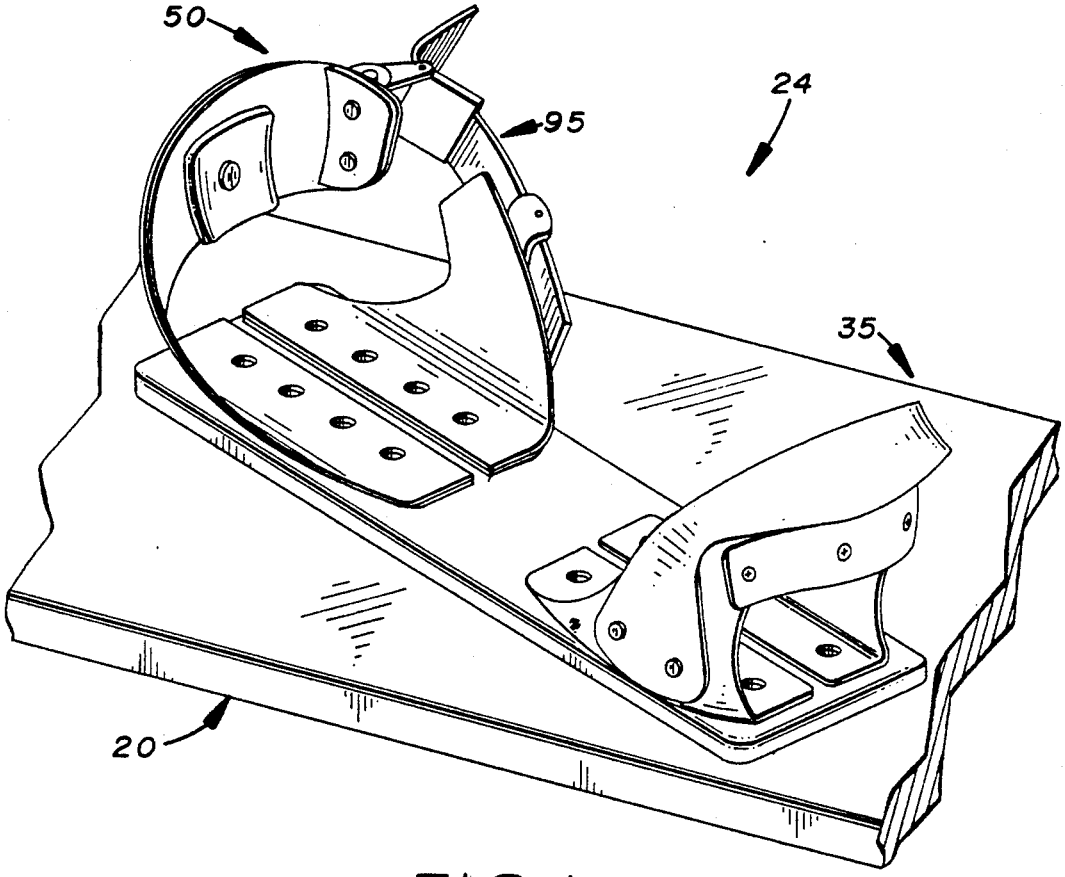
FIG. 1 is a perspective view of one embodiment of the binding disclosed herein.

As shown in FIG. 1, a binding 24 is provided to be used with a snowboard 20. The binding 24, which is essentially a step-in type binding adapted for use with a hard shell boot. The binding 24 is designed to be sufficiently flexible to allow limited lateral movement and axial rotation of the boot when attached thereto. The flexibility of the binding 24 may be selectively adjusted by the shredder so that the proper amount of lateral movement and axial rotation is allowed for either downhill and freestyle riding activities or in a combination of riding activities. In addition, the binding 24 is designed so that the shredder may easily and conveniently connect and disconnect the boot from the binding 24 for shredding at modern ski lift areas.

The binding 24 comprises a flexible heel piece 50 a semirigid toe piece 35, and a heel holding means comprising a heel plate 65. The flexible heel piece is designed to flexibly hold the rear portion of a boot on the snowboard 20 while the semi-rigid toe piece 35 is designed to hold the toe portion of the boot on the snowboard 20. An adjustable securing means comprising a strap structure 95 and an adjustable securing means is attached to the flexible heel piece 50 which allows the shredder to selectively adjust the tension of the flexible heel piece 50 and thereby adjust its flexibility. The heel holding means is mounted to the inside surface of the flexible heel holding means which engages the rear portion of the boot.

In FIGS. 2–16, another embodiment of the invention is shown having an optional base member 70 attached inside the binding between the flexible heel piece 50 and the semi-rigid toe piece 35. With binding 25, the base member 70 is used to control the direction and the amount of lateral rotation of the boot when connected to the binding 25. Some base member embodiments, discussed further below, are also used to control axial rotation of the boot while attached to the binding 25. The flexible heel piece 50 and the semi-rigid toe piece 35 used with bindings 24 and 25 shown in FIGS. 1 and 2, respectively, are nearly structurally identical and are functionally identical. The flexible heel piece 50 and semirigid toe piece 35 used with binding 25 are slightly higher to accommodate a base member disposed between them. With each binding 24 and 25, the relative size of the flexible heel pieces 50 and semi-rigid toe pieces 35 may be modified to accommodate different boot sizes and different base members.

Figure 2:
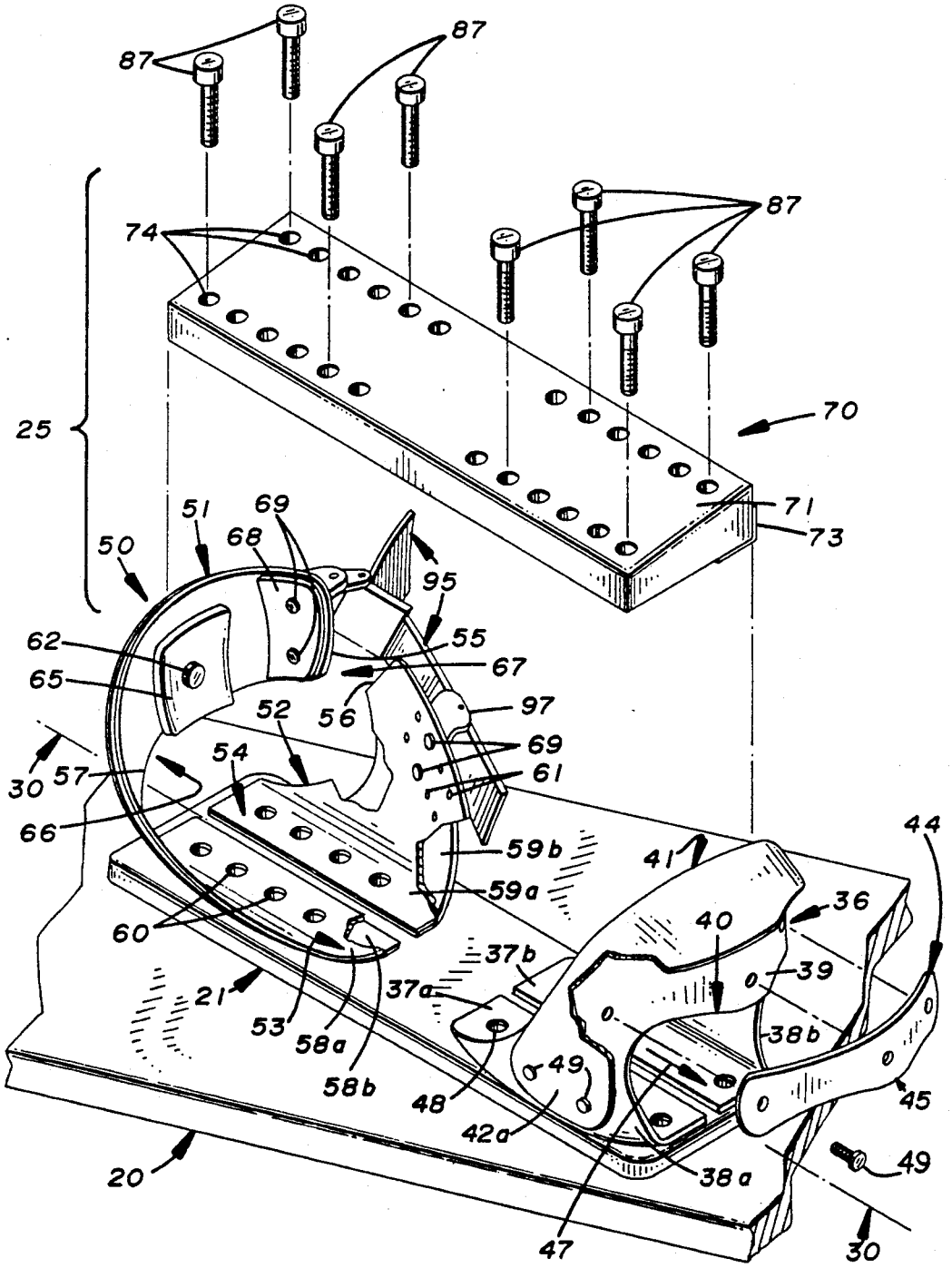
FIG. 2 is a perspective view, partially exploded of another embodiment of the binding with a base member attached thereto.

Referring to FIGS. 1–2, the semi-rigid toe piece 35 is attached to the front of the binding and is designed to securely hold the toe portion of a boot 23 therein. Although any suitable toe piece design may be used with the flexible heel piece 50, semi-rigid toe piece 35 is specifically designed to be strong and durable and to allow the shredder to slidingly engage the toe portion of the boot 23 therein during use.

Figure 3:
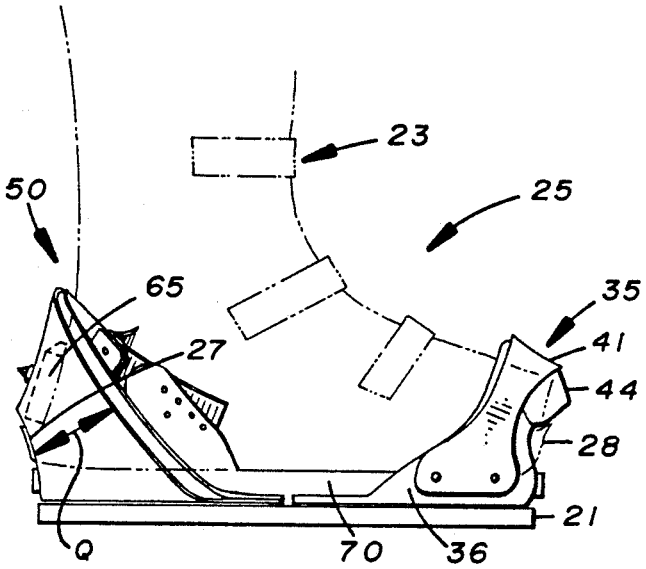
FIG. 3 is a side elevational view of the binding described herein.

As shown in FIGS. 2–3, the semi-rigid toe piece 35 comprises an upward extending bracket 36, a bracket support member 41, and a wing member 44. Bracket 36 has two horizontal right and left flange surfaces 37(*a*) and 37(*b*), respectively, two right and left vertical sides 38(*a*) and 38(*b*), respectively, and a vertical front surface 39. During assembly of the binding 25, the semi-rigid toe piece 35 may be attached to the top surface of an adaptor 21 (not part of the invention disclosed herein) or directly to the top surface of the snowboard 20. The semi-rigid toe piece 35 is manually positioned on the top surface of the adapter 21 so that the two flange surfaces 37(*a*) and 37(*b*) are disposed horizontally on opposite sides of the binding's longitudinal axis 30. During assembly, the front surface 39 is positioned above the top surface of the adapter 21 across the front of the binding 25. When assembly is completed, the front surface 39 is positioned above the flange surfaces 37(*a*) and 37(*b*) thereby creating a toe passageway 47 having sufficient size &o allow the toe portion of the boot 23 to slide therein. A plurality of holes 48 are manufactured on each flange surface 37(*a*) and 37(*b*) through which a flange connector 87 is extended through to attach the semi-rigid toe piece 35 to the top surface of an adaptor 21.

The bracket support member 41 is an inverted U-shaped structure which fits over bracket 36 to provide additional support thereto. Bracket support member 41 is approximately the same width as bracket 36. During assembly of the semirigid toe piece 35, the bracket support member 41 is attached to the bracket 36 so that the top surface of bracket support member 41 is disposed slightly above the front surface 39 of bracket 36. Each vertical side 42(*a*) and 42(*b*) of the bracket support member 41 is registered and attached to the outside surface of the vertical sides 38(*a*) and 38(*b*), respectively, of bracket 36 using two connectors 49. For bindings made for small children, not shown, in which the forces exerted on the semi-rigid toe piece 35 is substantially less, the bracket support member 41 may be eliminated.

Wing member 44 is registered and attached to the outside surface of the front surface 39 to provide additional support. The wing member 44 is complimentary in shape to the front surface 39 with the lower edge 45 aligned and registered with lower edge 40 of front surface 39. During assembly of the semi-rigid toe piece 35, the wing member 44 attaches to the outer, vertical surface of front surface 39 using three suitable connectors 49 spaced equally thereon.

Bracket 36, bracket support member 41, and wing member 44 are manufactured from lightweight, durable, strong, flexible materials. The material must be sufficiently strong to withstand the extreme temperatures and forces exerted by the boot 23 while shredding. The material used must also be sufficiently resilient so that force must be applied by the shredder in order to move in the binding 25, and sufficiently resistant to provide good edge control and edge feeling during use.

Figure 4:
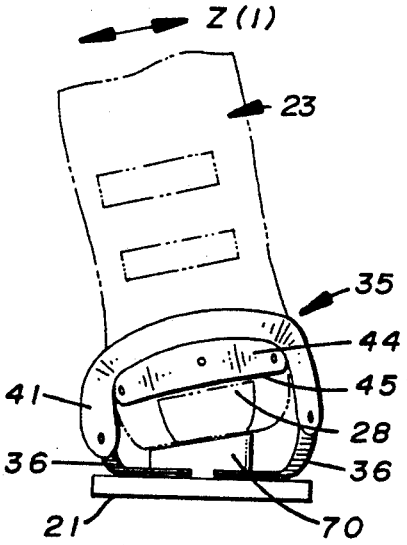
FIG. 4 is a front elevational view of the binding described herein.

As shown in FIG. 4, the semi-rigid toe piece 35 is designed so that when the boot 23 is placed in the semi-rigid toe piece 35, the lower edges 40 and 45 of the front surface 39 and the wing member 44, respectively, engage the toe lip structure 28 found on the front outer surface of a typical hard shell boot 23. Lower edges 40 and 45 press against the toe lip structure 28 and thereby helps to keep the boot 23 from being lifted upward and disconnecting from the semi-rigid toe piece 35. The lower edges 40 and 45 must be manufactured at an angle which can accommodate the position of the toe lip structure 28 when the boot 23 is connected to the binding 25. When base member 70 is connected to the binding 25, the semi-rigid toe piece 35 is manufacture so that lower edges 40 and 45 are disposed at an angle approximately 5 to 15 degrees above the horizontal axis. With binding 24 or with binding 25 with other base members attached thereto, the height of the semi-rigid toe piece 35 must be modified so that lower edges 40 and 45 will properly engage toe lip structure 28.

In the preferred embodiment, bracket 36, bracket support member 4 and wing member 44 are made of 1/8 inch nylon sheet material which are manually positioned to form semi-rigid toe piece 35 during assembly. Semi-rigid toe piece 35 allows the rear portion of the boot to move laterally when connected to the binding 25. Although other types of connections may be used during assembly, seven connectors 49 are required to sufficiently interconnect bracket 36, bracket support member 41, and wing member 44. By reducing the number of connectors 49 used, bracket 36, bracket support member 41 and wing member 44 are able to bend slightly which makes semi-rigid toe piece 35 slightly flexible.

Figure 5:
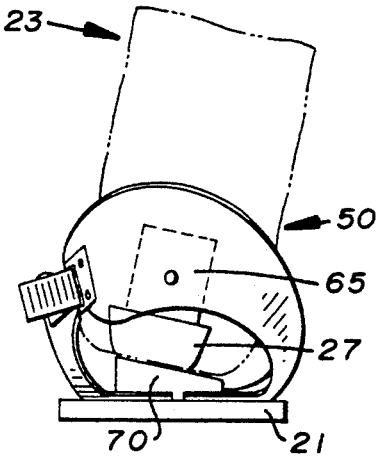
FIG. 5 is a rear elevational view of the binding described herein.

As seen in FIGS. 2, 3 and 5, the flexible heel piece 50 surrounds and flexibly holds the rear portion of the boot 23 in the binding 25 during use. Flexible heel piece 50 includes a first wrap member 51 and a second wrap member 52 which originate from opposite sides of the binding 25 and converge along their extending edges 55 and 56, respectively, to partially surround the rear portion of the boot 23. The adjustable securing means, described further below, pulls the first and second wrap members 51 and 52, respectively, together to tighten the flexible heel piece 50 around rear portion of the boot 23.

Each first and second wrap members 51 and 52, respectively, have flange surfaces, 53 and 54, respectively, which, during assembly, are disposed on opposite sides of the binding's longitudinal axis 30. Each flange surface 53 and 54 is sufficiently wide to allow the sole of a boot 23 to be placed thereon. Each flange surface 53 and 54 has a plurality of holes 60 manufactured thereon through which a flange connector 87 may be extended through to securely attach each wrap member 51 and 52 to the top surface of an adapter 21 or snowboard 20.

Both wrap members 51 and 52 are manufactured to extend upward from the snowboard surface and around the rear portion of the boot 23 when connected to the binding 25. When properly assembled, the extending edges 55 and 56 of the first and second wrap members 51 and 52, respectively, are disposed adjacent and opposite to each other. A space 67 is created between the extended edges 55 and 56 so that the first and second wrap members 51 and 52 may be pulled together and tightened around the boot 23. The lower edge 57 of the first wrap member 51 extends across the rear portion of the binding 25 above and over flange surface 53 thereby creating a heel passageway 66. When the boot 23 is connected to the binding 25, the rear portion of the boot's 23 heel may partially extend through the heel passageway 66.

Like the semi-rigid toe piece 35, the flexible heel piece 50 is manufactured to be lightweight, durable, strong, and flexible to allow limited longitudinal and lateral movement of the boot 23 when it is connected to the binding 25. As discussed further below, flexible heel piece 50 is also sufficiently flexible to allow limited axial rotation of the boot 23 when a suitable base member is used with the binding 25.

In the preferred embodiment, the first and second wrap structures 51 and 52, respectively, are laminated structures each comprising an inner layer and an outer layer 58(*a*), 58(*b*); and 59(*a*), 59(*b*), respectively. Each layer 58(*a*), 58(*b*), 59(*a*), and 59(*b*) is made of ⅛ inch nylon sheet material identical to the material used to manufacture the bracket 36, bracket support member 41, and wing member 44 of semi-rigid toe piece 35. Although in the embodiment shown, the inner and outer layers 58(*a*), 58(*b*) and 59(*a*) and 59(*b*) of the first and second wrap members 51 and 52, respectively, have complimentary shapes, in other embodiments, not shown, the thickness and the dimension "Q", shown in FIG. 3, of each layer 58(*a*), 58(*b*), 59(*a*), and 59(*b*), may be varied to adjust the flexibility of the flexible heel piece 50. With each thickness and size used, however, the material must be sufficiently strong to withstand extreme temperatures and the forces exerted on the flexible heel piece 50 when shredding.

Adjacent inner and outer layers 58(*a*) and 58(*b*); and 59(*a*) and 59(*b*) are connected together at selected locations so that the flexible heel piece 50 is flexible. As stated above, the flexible heel piece 50 is designed to be more flexible than the semi-rigid toe piece 35. The flexible heel piece 50 is attached to the adaptor 21 using flange connectors 87 which extend through holes 60 located on the flange surfaces 53 and 54. A heel plate connector 62, discussed further below, attaches the outer layer 58(*b*) to the inner layer 58(*a*) of the first wrap member 51. The two strap connectors 69, which are used to attach the ratchet locking device 97 to the outer surface of the second wrap member 52, are used to interconnect inner layer 59(*a*) to outer layer 59(*b*). No other adhesives or connectors are used to interconnect layers 58(*a*) and 58(*b*) and layers 59(*a*) and 59(*b*). By limiting the number of interconnects between them, the adjacent inner and outer layer 58(*a*) and 58(*b*); and 59(*a*) and 59(*b*), respectively, are able to bend and to move independently thereby increasing the overall flexibility and strength of the flexible heel piece 50.

As seen in FIG. 2, the adjustable securing means comprises a strap structure 95 attached to the outside surface of the first wrap structure 51 near the extending edge 55, and an adjustable locking means, which in the preferred embodiment comprises a ratchet locking device 97, attached to the outside surface of the second wrap structure 52 near the extending edge 56. The strap structure 95 and ratchet locking device 97 are similar to the strap structures and locking means used with typical high-back bindings. The strap structure 95 and the ratchet locking device 97 allow the shredder to adjustably tighten the flexible heel piece 50 around the rear portion of the boot using one hand. Also, by adjusting the tension of the strap structure 95, the shredder is able to adjust the flexibility of the flexible heel piece 50 and the tightness of the heel plate 65 against the heel lip structure 27. Extra holes 61 are manufactured through the second wrap member 52 to allow the shredder to adjust the position of the ratchet locking device 97 thereon. This allows the shredder to adjust the position of the ratchet locking device 97 on the outside surface of the second wrap member 52 for different boot sizes. A concave-shaped strap plate 68, which acts to strengthen and support the extending edge 55, is attached to the inside surface of the first wrap member 51 near extending edge 55. The strap plate 68 is attached to the inside surface of the first wrap member 51 using a plurality of strap connectors 69 which extend through the first wrap member 51 and hold the bracket member for strap structure 95 to the outside surface on the first wrap member 51. The ratchet locking device 97 is attached to the outside surface of the second wrap structure 52 using two strap connectors 69.

As shown in FIGS. 1 and 2, the heel holding means for bindings 24 and 25 comprise a heel plate 65 mounted to the inside surface of the first wrap member 51. The heel plate 65 is disposed on the first wrap member 51 so that when the first wrap member 51 is wrapped around the rear portion of the boot 23, the heel plate 65 is aligned inside the binding 25 substantially perpendicular to the binding's longitudinal axis 30. When a boot 23 is placed in the binding 25, the first wrap member 51 is pulled around the rear portion of the boot 23 and the heel plate 65 partially engages the heel lip structure 27 and presses it downward in the binding. With binding 24, the lower horizontal edge of the heel plate is approximately 1½ inches above the top of the flanges surfaces 53 and 54. With binding 25, designed for use with a base member 70, the distance between the lower horizontal edge and the flange surfaces 53 and 54 is increased an amount equal to the thickness of the base member.

In the preferred embodiment, the heel plate 65 is a square or rectangular-shaped plate with an inner concave surface. The heel plate 65 is attached to the inside surface using a heel plate connector 62. Heel plate 65 is designed to engage the heel lip structure 27 located above the heel on a typical hard shell boot 23. The first wrap member 51 is resilient so that as the shredder steps into the binding 25, the heel plate 65 maintains its position and automatically engages the heel lip structure 27 as the shredder presses the boot 23 into the binding. This features allows the bindings 24 and 25 to be a step-in type bindings. Before actually shredding, the shredder must tighten the first and wrap member 51 around the boot 23 by pulling the strap structure 95 through the ratchet locking device 97. As the strap structure 95 is tightened, the heel plate 65 is pulled forward and downward over the heel lip structure 27 pressing the heel downward. The shredder can adjust the tension of the strap structure 95 to adjust the flexibility and downward pressure exerted by the heel plate 65 on the heel lip structure 27. In the preferred embodiment, the heel plate 65 is made of light aluminum or some other light, durable material approximately ¼ inch thick.

Figure 6:
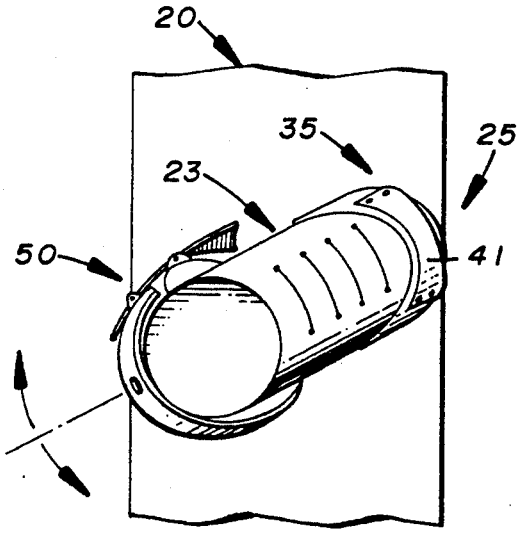
FIG. 6 is a plan view of the binding with a boot connected therein showing the lateral movement of the rear portion of the boot.

As shown in FIG. 6, the semi-rigid toe piece 35 and the flexible heel piece 50, allows the shredder to laterally move the rear portion of the boot 23 while connected to the binding 25. The actual amount of the lateral movement depends upon the inherent flexibility of the flexible heel piece 50 and tension of the strap structure 95 as stated above. By manufacturing the inner and outer layers 58(*a*), 58(*b*) and 59(*a*), 59(*b*) of the first and second wrap structures 51 and 52, respectively, in different sizes and shapes, and by adjusting the tightness of the strap structure 95, the flexibility of the flexible heel piece 50 may be adjusted. As discussed further below, when a base member is attached to the binding 25, the shape of the upper boot support surface of the base member also controls the shredder's ability to laterally move the rear portion of the boot 23 when attached to the binding 25.

As shown in FIG. 2, a base member 70 may be disposed horizontally along the longitudinal axis 30 of the binding 25 between the flexible heel piece 50 and the semi-rigid toe piece 35. The base member 70 is an elongated structure having a width approximately equal to the width of the sole of a typical hard shell boot 23. The base member 70 has an upper boot support surface 71 upon which the sole of the shredder's boot 23 is placed when connected to the binding 25. A plurality of holes 74 are manufactured through the base member 70 which, during assembly of the binding 25, are aligned and registered with the holes 48 and 60 located on the semi-rigid toe piece 35 and flexible heel piece 50, respectively. Extra holes 74 may be manufactured on the base member 70 to allow the base member 70 to be used with adapters 21 having different hole patterns and to allow the shredder to adjust the distance between the semi-rigid toe piece 35 and the flexible heel piece 50 for different boot sizes. As shown in FIG. 2, an optional support angle 73 may be attached to a longitudinal edge of the base member 70 to provide additional strength and support.

The upper boot support surface 71 of the base member 70 supports the boot 23 when connected to the binding 25. As shown more clearly in FIGS. 3–5, 11(*a*), and 12(*a*), the upper boot support surface 71 is an angled surface 72 manufactured for ergonomic reasons, at between 5 to 15 degrees from the horizonal axis. When the binding 25 is used on either the front or rear binding site, the downhill side of the angle surface is positioned towards the center of the snowboard 20. As shown in FIG. 13(*a*), when the strap structure 95 is properly adjusted, the shredder is able to move the rear portion of boot 23 laterally along the axis Z(1) over the upper boot support surface 71 As discussed above, the actual amount of lateral movement depends upon the tension of the strap structure 95.

Figures 11A, 11B, 11C, 11D:
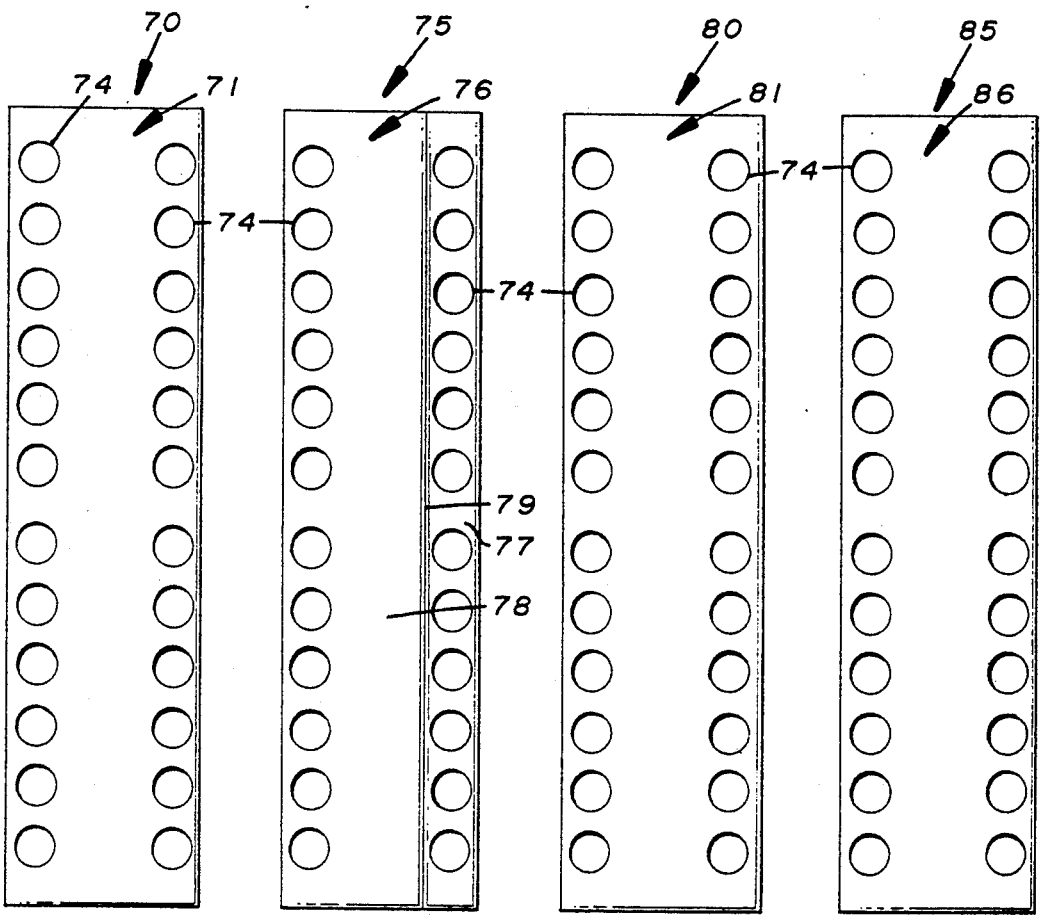
FIGS. 11(*a*)–(*d*) are four plan views showing four alternative embodiments of the base member capable of being used with the binding.
Figures 12A, 12B, 12C, 12D:
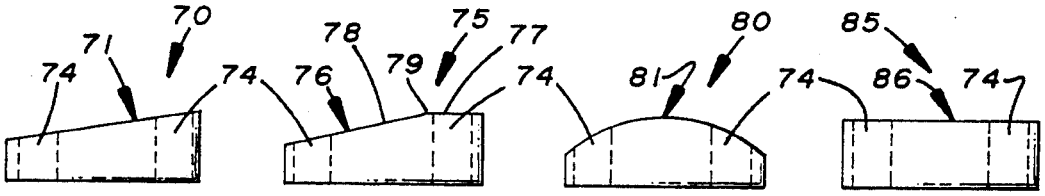
FIGS. 12(*a*)–(*d*) are four end elevational views of the four alternative embodiments of the base member shown in FIGS. 11(*a*)–(*d*).
Figure 13A:
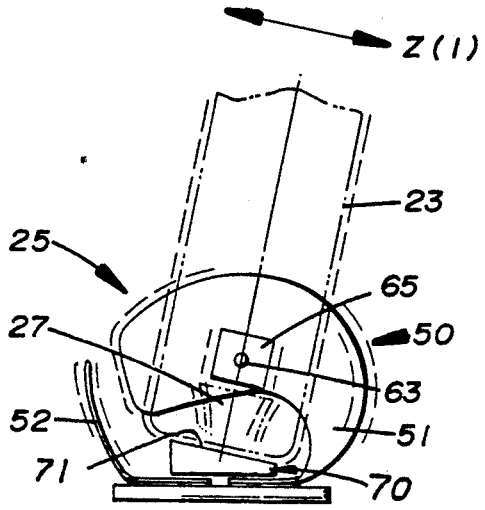
FIGS. 13(*a*)–(*d*) illustrates the lateral movement and/or axial rotation permitted with each alternative embodiment of the base members shown in FIGS. 11(*a*)–(*d*) and 12(*a*)–(*d*).
Figure 13B:
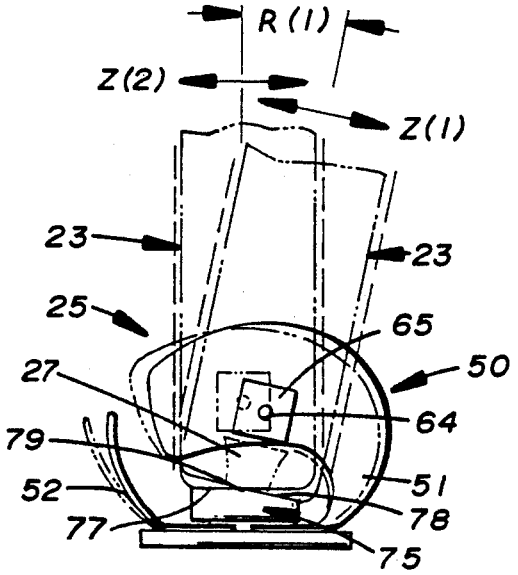
Figure 13D:
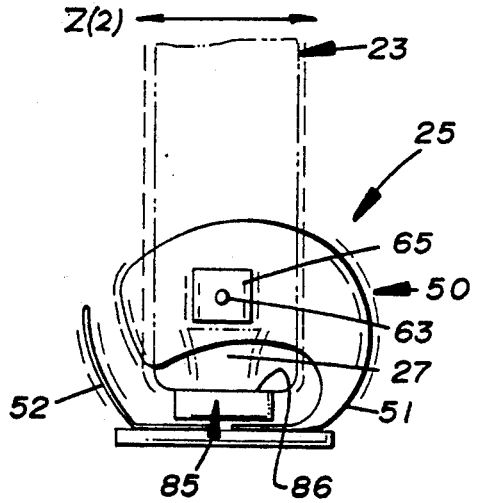
Figure 13C:
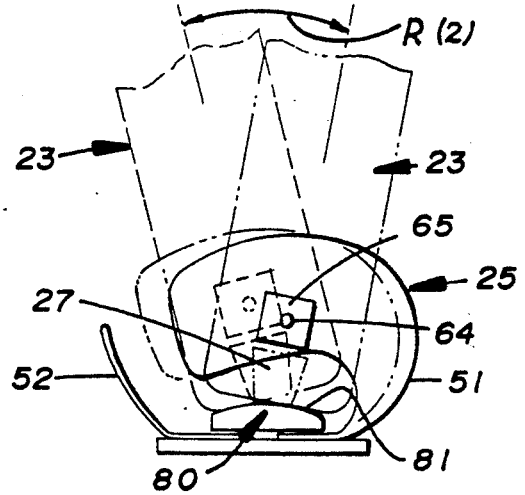

In FIGS. 11(*b*)–(*d*) and 12(*b*)–(*d*), other embodiments of the base member 75, 80, and 85 are shown having different upper boot support surfaces 76, 81, and 86, respectively. Two base members 75, and 80 are designed to allow both lateral movement and axial rotation of the boot 23 when connected to the binding 25. More specifically, base member 75, shown in FIGS. 11(*b*) and 12(*b*), has a bi-angled upper boot support surface 76 comprising an upper horizontal surface 77 and a sloped surface 78. The upper horizontal surface 77 and the sloped surface 78 are joined at an adjoining edge 79. As shown in FIG. 13(*b*), when base member 75 is attached to the binding 25, the shredder can position the sole of the boot 23 on either the upper horizontal surface 77 or the angled surface 78. When placed on upper horizontal surface 77, the shredder can move the boot 23 laterally along axis Z(2). When placed on the sloped surface 78, the shredder can move the boot 23 along axis Z(1). In order to rotate the rear portion of the boot 23 along arc R(1), the heel plate 65 must be pivotally attached to the flexible heel piece 50. As the shredder laterally moves the rear portion of the boot 23 the first and second wrap members 51 and 52 move laterally keeping the heel plate 65 pressed against the heel lip structure 27 to hold the boot 23 downward in the binding 25 at all times.

With base member 80, shown in FIGS. 11(*c*), and 12(*c*), the upper boot support surface 81 comprises an upward curved surface. As shown in FIG. 13(*c*), when connected to the binding 25, the upward curved surface 81 allows the shredder to dispose the sole of the boot 23 in any position tangent to surface 81. While shredding, the shredder axially rotates the boot 23 anywhere along the arc R(2). Because surface 81 does not offer resistance to movement, control of snowboard is more difficult at higher speeds, while greater agility is achieved at slower speeds for performing freestyle maneuvers.

Figure 14:
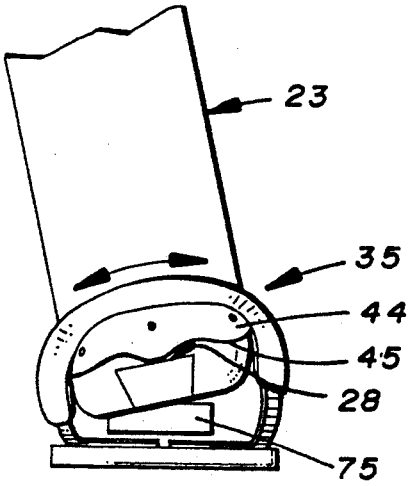
FIG. 14 is a plan view of the semi-rigid toe piece with a wing member attached with a curved lower edge.

In order for axial rotation to occur with base members 75 and 80, heel plate connector 62 must be replaced with pivotally connector 64 thereby allowing heel plate 65 to rotate. In addition, as shown in FIG. 14, with base members 75 and 80 (not shown) the lower edges of the front surface (not shown) and the wing member 44, may be curved so that the toe lip structure 28 of boot 23 may easily roll thereunder.

With base member 85, shown in FIGS. 11(*d*) and 12(*d*), the upper boot support surface 86 a substantially flat, horizontal surface. As shown in FIG. 13(*d*), base member 85 allows only lateral movement of the boot 23 along axis Z(2) and no axial rotation of the boot 23 permitted.

Figure 7:
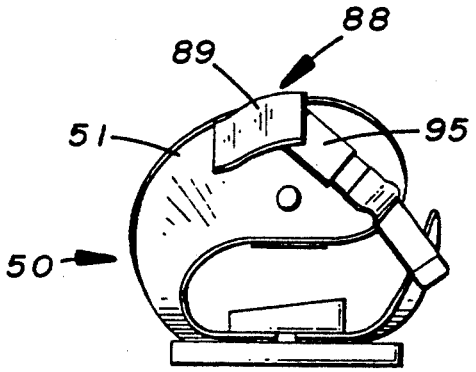
FIG. 7 is a rear elevational view of the binding described herein with an optional snow deflector attached to the rear surface of the flexible heel piece.

As shown in FIG. 7, an optional snow deflector 88 may be attached to the outside surface of the flexible heel piece 50 when the binding 25 is used in the rear binding position on a snowboard 20. The snow deflector 88 prevents snow and ice from accumulating under the strap structure 95 and thereby causing it to inadvertently open while shredding. In the preferred embodiment, the snow deflector 88 comprises an upward curved, rectangular plate structure 89 which is attached at one end to the outside surface of the first wrap member 51. The snow deflector 88 is positioned on the first wrap member 51 so that it angles upward and overlaps the free end of the strap structure 95.

Figure 8:
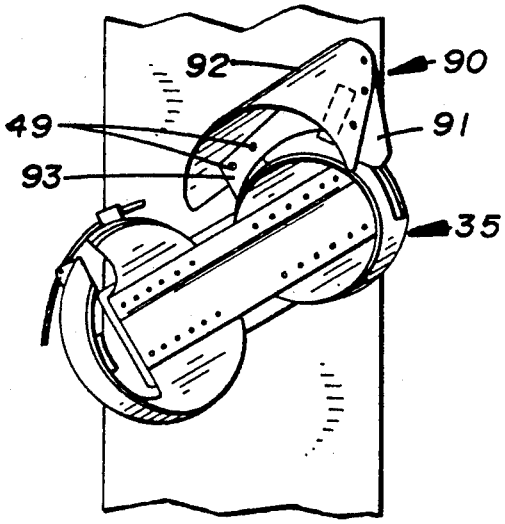
FIG. 8 is a plan view of the binding described herein with an having an optional snow shield attached to the front outer surface of the semi-rigid toe piece.
Figure 9:
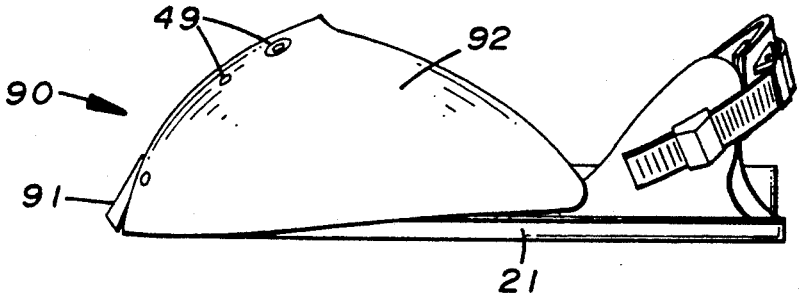
FIG. 9 is a side elevational view of the binding shown in FIG. 8.
Figure 10:
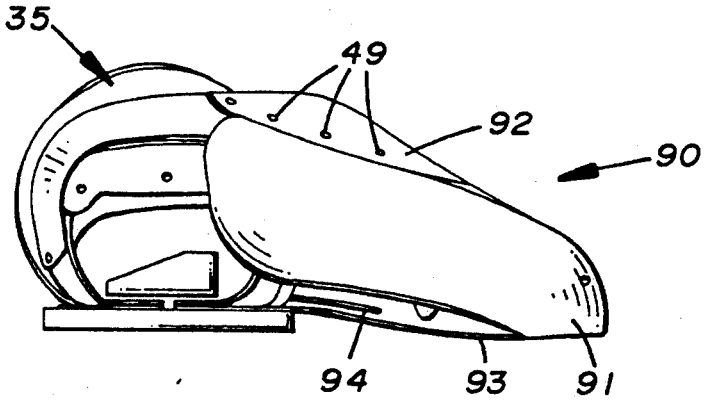
FIG. 10 is a front elevational view of the binding shown in FIGS. 8 and 9.

As shown in FIGS. 8–10, an optional snow shield 90 is also provided attached to the forward, outside surface of the semi-rigid toe piece 35 when the binding is used in the front binding position on a snowboard 20. Snow shield 90 is used to prevent snow build-up on the front surface of the semi-rigid toe piece 35 and to prevent snow from entering the semi-rigid toe piece 35 during use. When shredding at fast speeds, the snow shield 90 also acts to streamline the flow of snow and air over the binding 25 to prevent yawing. The snow shield 90 comprises a front shield member 91, a side shield member 92, a bottom member 93, and a stiffener 94. The upper edge of the front shield member 91 and front edge of the side shield member 92 overlap and are attached together along a front seam using suitable connectors 49. The upper corner of the side shield member 92 is attached to the top surface of the bracket support member 41. The side shield member 92 extends laterally and forward from the semi-rigid toe piece 35 towards the tip of the snowboard 20. The extending edge of the side shield member 92 extends downward and attaches to the bottom member 93 along a lateral seam with suitable connectors 49. The bottom member 93 extends laterally and horizontally from the semi-rigid toe piece 35. In the preferred embodiment, holes (not shown) are manufactured along the bottom member 93 so that it may be attached to the binding 25 between the bottom surface of the semi-rigid toe piece 35 and the top surface of the adapter 21. The rectangular-shaped stiffener 94 may be attached to the inside surface of the bottom member 93 to provide additional support and strength thereto.

Figure 15:
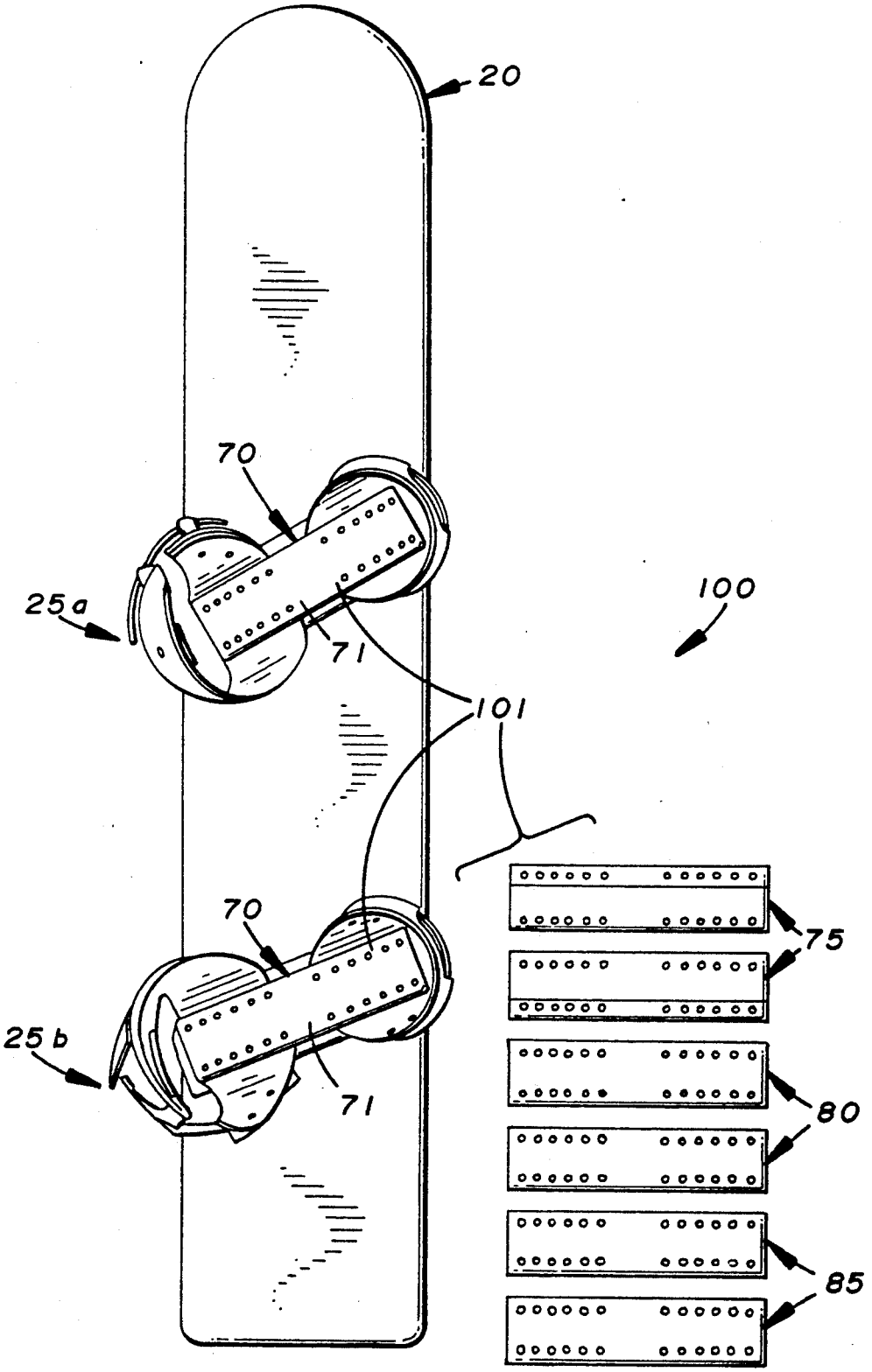
FIG. 15 is a plan view showing the binding system disclosed herein comprising a left and a right-opening binding mounted on the front and rear binding positions, respectively, and a set of eight base members.
Figure 16A:
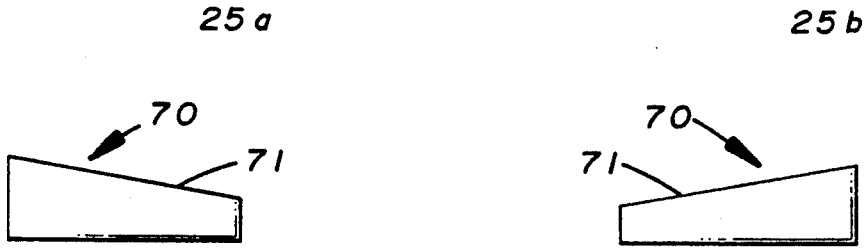
FIGS. 16(*a*)–(*d*) are end elevational views of the alternative pairs of base members selected from the set shown in FIG. 15 and used with the left and right-opening bindings.
Figure 16B:
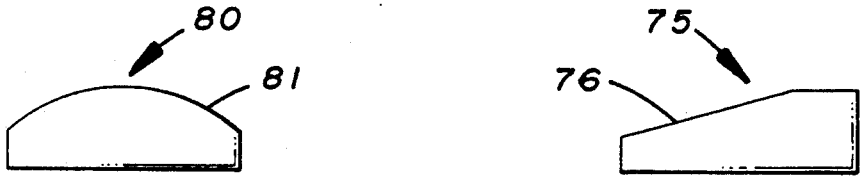
Figure 16C:
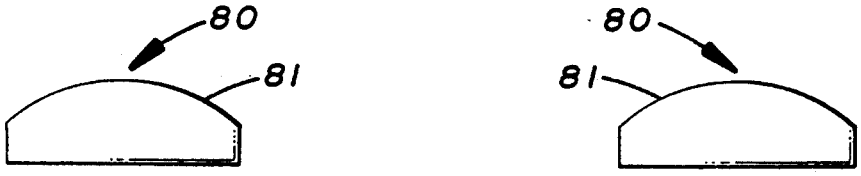
Figure 16D:
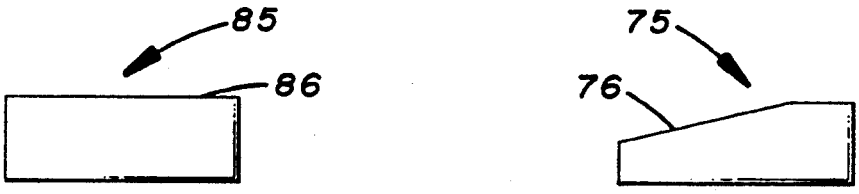

As shown in FIG. 15, the binding 25 is manufactured for use in both the front and rear binding positions on a snowboard 20. It has been found, that it is easier to connect and disconnect a boot 23 from the binding 25 if the strap structure 95 for each binding 25 is located on the outside surface. Therefore, the arrangement shown in FIG. 15, is designed for right-footed shredders who would use a leftopening binding, referred to as 25(*a*), in the front binding position and a right-opening binding, referred to as 25(*b*), in the rear binding position. For left-footed shredders, the positions of the left-opening binding 25(*a*) and right-opening binding 25(*b*) are reversed.

In operation, the bindings 25(*a*) and 25(*b*) are first attached to the top surface of the snowboard 20. The shredder first inserts his front boot 23 (left foot) in the binding 25(*a*). He then loosely attaches the strap structure 95 to the ratchet locking device 97. The shredder's rear boot remains detached thereby allowing him to ride "skate board-style" across the terrain to the chair-lift or rope tow facility. As the shredder enters the chair-lift or row tow facility, he then partially connects the rear boot 23 to the binding 25(*b*) by first inserting the toe of the boot 23 into the semi-rigid toe piece 35 and then placing the heel of the boot into the flexible heel piece 50 and pressing downward. As the heel of the boot 23 is pressed downward into the flexible heel piece 50, the first and second wrap members 51 and 52, respectively, are pushed outward and the heel plate 65 engages the heel lip structure 27. With the boot 23 partially connected to the binding 25 in this manner, the shredder is able to ride the chair-lift safely without loosing the snowboard and is able to sufficiently control the snowboard upon exiting the chair-lift or rope tow facility.

After riding and exiting the chair-lift or rope tow facility, the shredder then stops and securely connects each boot 23 to its binding 25(*a*) and 25(*b*). The shredder reaches down and pulls the strap structure 95 through the ratchet locking device 97 located on each binding 25(*a*) and 25(*b*). As the strap structures 95 are tightened, the extending edge 55 of the first wrap members 51 is pulled forward and slightly downward towards the extending edge 56 of the second wrap members 52. The ratchet locking device 97 automatically engages the strap structure 95 to hold the first and second wrap members 51 and 52, respectively, in the locked position. As the first wrap member 51 is pulled forward and slightly downward, the heel plate 65 fully engages the heel lip structure 27 to securely hold boot 23 in the binding 25. By adjusting the tension of the strap structure 95, the shredder is able to adjust the flexibility of the flexible heel piece 50 for different riding activities. When shredding is completed, the shredder disengages the strap structure 95 from the ratchet locking device 97, loosens the flexible heel piece 50, and steps out of the binding 25.

As mentioned above, one of the essential features of the invention disclosed herein is that while shredding, the shredder is able to laterally move the rear portion of the boot and, with some embodiments, axially rotate the boot 23 when connected to the binding 25. In addition to these movements, the shredder may also be able to move the boot 23 longitudinally when connected to the binding 25. The actual amount of longitudinal movement is dependent upon the tightness of the strap structure 95, the relative distance between the semi-rigid toe piece 35 and the flexible heel piece 50, and the flexibility of the semi-rigid toe piece 35. When longitudinal movement is possible, the flexibility of the flexible heel piece 50 allows the heel plate 65 to move slightly forward or backward along the longitudinal axis 30 so that the boot 23 remains engaged with the heel lip structure 27.

Using a left and a right-opening binding 25(*a*) and 25(*b*), respectively, along with a plurality of different base members a binding system may be used which enable the shredder to use one snowboard for different riding activities. In the preferred embodiment, the base members comprise four pairs of base members 70, 75, 80, and 85. As shown in FIG. 15, the binding system, generally referred to by the number 100 comprises a left and right-opening binding, 25(*a*) and 25(*b*), respectively, attached to the front and the rear binding position, respectively, of a snowboard 20, and a set of eight exchangeable base members, generally referred to by the number 101. As stated above the locations of the bindings 25(*a*) and 25(*b*) may be reversed for left-footed shredders. The set of eight base members 10 comprise the following: two base members 70 each having an upper boot support surface comprising an angled surface 71; two base members 75 each having a bi-angled upper boot support surface 76, two base members 80 each having an curved upper boot support surface 81, and two base members 85 each having a flat upper boot support surface 86.

When shredding, any combination of two base members are first selected from the set 101 and attached to the bindings 25(*a*) or 25(*b*). Which base members are selected and attached to one of the bindings 25(*a*) or 25(*b*) depends upon the type of riding activity. For a right-foot shredder, the shredder first selects a snowboard 20 having a left-opening binding 25(*a*) and a right-opening binding 25(*b*) described above attached thereto. The shredder then selects two exchangeable base members 70, 75, 80, and 85 from the set 101 having the upper boot support surfaces manufactured which are best suited for the desired riding activity or a combination of activities. The shredder then attaches the selected base members 70, 75, 80, or 85 to the appropriate binding 25(*a*) or (*b*) and begins shredding. When the shredder wants to participate in a different riding activity, he then selects one or two base members from the set 101 and exchanges them with the first base members. The shredder continues to select and exchange the pairs base members for each riding activity. The inventor has discovered that certain pairs of base members are better suited for specific riding activities than others. FIGS. 16(*a*)–(*d*) shows four base member pairs that may be used with the left and right opening bindings 25(*a*) and 25(*b*), respectively. The base members shown in the left side columns are connected to the left-opening binding 25(*a*) located in the front binding position while the base members shown in the right side column are connected to the right-opening binding 25(*b*) located in the rear binding position.

FIG. 16(*a*) shows base member 70 used in left-opening binding 25(*a*) and base member 70 is used in the right-opening binding 25(*b*). It has been found that this combination allows the shredder to obtain a relatively comfortable riding position with both feet canted inwardly. This combination is suited for downhill activities.

FIG. 16(*b*) shows base member 80 is used in the leftopening binding 25(*a*) and base member 75 is used in the rightopening binding 25(*b*). This provides the shredder with a good, all-around binding combination which allows the shredder to participate in both downhill and freestyle riding activities. By using base member 80 in binding 25(*a*) in the front binding position, allows the shredder to make good heel or toe side turns without loosing control.

As shown in FIG. 16(*c*), base member 80 is used both in the left-opening binding 25(*a*) and the right-opening binding 25(*b*) With this combination, the snowboard 20 is set up for freestyle riding activities where lateral movement of the boots while connected to the bindings are desired. This combination is undesirable for downhill riding activities, because resistance by the shredder against snowboard movement at higher speeds is more difficult.

As shown in FIG. 16(*d*), base member 85 is used in the left-opening binding 25(*a*) and base member 75 is used in the right-opening binding 25(*a*). With this combination, the snowboard 20 is set up for intermediate downhill riding activities.

In compliance with the statute, the invention has been described in language more or less specific as to the elements or steps required to practice the invention. It is understood, however, that the invention is not limited to the elements or steps described herein, since they describe the preferred manner of putting the invention into practice. The invention is therefore, claimed in any of its forms or modifications within the legitimate and valid scope of the appended claims properly interpreted in accordance with the doctrine of equivalents.

INDUSTRIAL APPLICABILITY

The invention disclosed herein, will have wide application in the industries where binding devices are used to secure a user's foot to a vehicle. Such industries include not only the snowboarding industry, but also the snow and water ski industries, the skate boarding industry, and the surfboard industry. More particularly, the binding itself is designed to be used with hard shell boots. It is conceivable that the binding may be modified and used with soft shell boots. In addition, many separate elements described in the invention, such as the base member with its various upper boot support surfaces, may have independent uses in still other industries.

I claim:

1. A binding used to secure a hard shell boot to the top surface of a snowboard, comprising:

a. a flexible heel piece attached to the top surface of said snowboard, said flexible heel piece comprising a first wrap member and a second wrap members attached to said top surface of said snowboard on opposite sides of said binding, said first wrap member and said second wrap members each having an outside surface and an extending edge, said first wrap member and aid second wrap member capable of being wrapped partially around the rear portion of said boot when said boot is attached to said binding;

b. an adjustable securing means attached to said flexible heel piece, said adjustable securing means being capable of pulling said extending edges of said first wrap member and said second wrap member together to wrap said first wrap member and said second wrap member around said rear portion of said boot;

c. a heel holding means mounted to said inside surface of said flexible heel piece, said heel holding means being capable of engaging and allowing selective lateral movement and axial rotation of said boot when connected to said binding, and;

d. a semi-rigid toe piece attached to said top surface of said snowboard in front of said flexible heel piece, said toe piece capable of receiving and securing the toe portion of said boot when said boot is attached to said binding.

2. A binding as recited in claim 1, wherein said first wrap member and said second wrap member are laminated structures each having an inner layer and an outer layer.

3. A binding as recited in claim 2, wherein said first wrap member and said second wrap member are made of nylon sheet material.

4. A binding as recited in claim 3, wherein said adjustable securing means comprises a strap structure and an adjustable locking means, said strap structure being attached at one end to said outside surface of said first wrap member, said adjustable locking means being attached to said outside surface of said second wrap member, said strap structure and said adjustable locking means capable of being interconnected to adjust the tension of said first wrap member and said second wrap member around said boot when said boot is attached to said binding.

5. A binding as recited in claim 1, wherein said semi-rigid toe piece comprises an upward extending bracket and a bracket support member, said upward extending bracket attached to said top surface of said snowboard and capable of slidingly receiving the toe portion of said boot when attached to said binding, said bracket support member being attached over said upward extending bracket to provide support thereto.

6. A binding as recited in claim 1, wherein said heel holding means is a heel plate mounted to said inside surface of said flexible heel piece.

7. A binding as recited in claim 6, wherein said heel plate is pivotally mounted to said inside surface of said flexible heel piece to enable said boot to axially rotate when attached to said binding.

8. A binding as recited in claim 1, further comprising a base member rigidly attached to said binding between said flexible heel piece and said semi-rigid toe piece, said base member having an upper boot support surface upon which a portion of the sole of said hard shell boot is placed when said hard shell boot is connected to said binding, said upper boot support surface being used to support said boot and to control lateral movement and axial rotation of said boot when attached to said binding.

9. A binding as recited in claim 8, wherein said base member has an angled upper boot support surface.

10. A binding as recited in claim 8, wherein said base member has a bi-angled upper boot support surface comprising a sloped surface and a narrow horizontal surface.

11. A binding as recited in claim 8, wherein said base member has a upward curved upper boot support surface.

12. A binding as recited in claim 8, wherein said base member has a flat upper boot support surface.

13. A binding as recited in claim 1, further comprising a snow shield attached forward and laterally to said semi-rigid toe piece to prevent snow build-up over said toe piece and to prevent snow from entering said semi-rigid toe piece while shredding.

14. A binding as recited in claim 1, further comprising a snow deflector attached to said flexible heel piece, said snow deflector being capable of preventing snow from opening said adjustable securing means while shredding.

15. A binding for securing a hard shell boot to a snowboard, comprising:

(a) a flexible heel piece attached to said snowboard, said flexible heel piece comprising a first wrap member and a second wrap member attached on opposite sides of said binding, said first wrap member and said second wrap member being of sufficient shape and size to wrap partially around the rear portion of said boot when attached to said binding, said first wrap member and said second wrap member each having an inside surface and being sufficiently flexible to allow limited lateral movement and axial rotation of said hard shell boot when attached to said binding;

(b) a heel plate mounted to said inside surface of said first wrap member, said heel plate being capable of engaging and holding said rear portion of said boot in said flexible heel piece;

(c) a strap structure attached at one end to said first wrap member of said flexible heel piece;

(d) an adjustable locking means interposed between said first wrap member and said second wrap member, said adjustable locking means capable of being interconnected with said strap structure to adjust the tension of said flexible heel piece around said boot, and;

(e) a semi-rigid toe piece rigidly attached to said snowboard in front of said flexible heel piece, said semi-rigid toe piece capable of slidingly receiving and holding the toe portion of said boot on said snowboard.

16. A binding, as recited in claim 15, further comprising an elongated base member rigidly attached to said snowboard between said semi-flexible toe piece and said flexible heel piece, said base member having an upper boot support surface capable of supporting said boot when said boot is placed thereon.

17. A binding, as recited in claim 16, wherein said base member has an angled upper boot support surface.

18. A binding, as recited in claim 17, wherein said base member has a flat upper boot support surface.

19. A binding, as recited in claim 16, wherein said heel plate is pivotally mounted to said inside surface of said flexible heel piece.

20. A binding, as recited in claim 19, wherein said base member has a bi-angled upper boot support surface comprising a sloped surface and a narrow horizontal surface.

21. A binding, as recited in claim 19, wherein said base member has a upward curved boot support surface.

22. A binding system attaching hard shell boots to a snowboard, comprising:

a. a left and right opening binding attached to the top surface of said snowboard, each said binding comprising a flexible heel piece having an inside surface, said flexible heel piece being sufficiently flexible to allow selective lateral movement and axial rotation of said boot when attached to said binding, a heel holding means pivotally mounted to said inside surface of said flexible heel piece and capable of engaging the rear portion of a hard shell boot when attached to said binding, an adjustable securing means attached to said flexible heel piece capable of adjusting the tension of said flexible heel piece around said boot when attached to said binding, a semi-rigid toe piece being attached to said snowboard in front of said flexible heel piece, said toe piece being capable of slidingly receiving and holding the toe portion of said boot on said snowboard when attached to said binding, and;

b. a set of exchangeable base members containing at least two base members, each said base member capable of being rigidly attached between said flexible heel piece and said semi-rigid toe piece of each said binding, each said base member having a boot support surface capable of disposing said boot in a selected position when attached to said binding.

23. A binding, as recited in claim 22, wherein said set of base members comprises the following:

a. two base members each having an angled upper boot support surface;

b. two base members each having a bi-angled upper boot support surface comprising a sloped surface and a narrow horizontal surface;

c. two base members each having an upward curved upper boot support surface, and;

d. two base members each having a flat upper boot support surface.

* * * * *